US010480854B2

(12) United States Patent
Huntington et al.

(10) Patent No.: US 10,480,854 B2
(45) Date of Patent: Nov. 19, 2019

(54) LIQUEFIED NATURAL GAS PRODUCTION SYSTEM AND METHOD WITH GREENHOUSE GAS REMOVAL

(71) Applicants: Richard A. Huntington, Spring, TX (US); Parag A. Gupte, Sugar Land, TX (US); Fritz Pierre, Jr., Humble, TX (US); Robert D. Denton, Bellaire, TX (US)

(72) Inventors: Richard A. Huntington, Spring, TX (US); Parag A. Gupte, Sugar Land, TX (US); Fritz Pierre, Jr., Humble, TX (US); Robert D. Denton, Bellaire, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 589 days.

(21) Appl. No.: 15/182,035

(22) Filed: Jun. 14, 2016

(65) Prior Publication Data

US 2017/0016667 A1 Jan. 19, 2017

Related U.S. Application Data

(60) Provisional application No. 62/192,654, filed on Jul. 15, 2015.

(51) Int. Cl.

| | |
|---|---|
| ***F25J 3/08*** | (2006.01) |
| ***F25J 1/00*** | (2006.01) |
| ***F25J 3/02*** | (2006.01) |

(52) U.S. Cl.
CPC ..... *F25J 3/08* (2013.01); *F25J 1/0022* (2013.01); *F25J 1/0072* (2013.01); *F25J 3/0257* (2013.01);
(Continued)

(58) Field of Classification Search
CPC ..... F25J 1/0022; F25J 1/0035; F25J 1/0042; F25J 1/0072; F25J 1/0221; F25J 1/023;
(Continued)

(56) References Cited

U.S. PATENT DOCUMENTS

| | | | | |
|---|---|---|---|---|
| 3,180,709 A | 4/1965 | Yendall et al. | ..... | 23/210 |
| 3,347,055 A | 10/1967 | Blanchard et al. | ..... | 62/9 |

(Continued)

FOREIGN PATENT DOCUMENTS

| | | | | |
|---|---|---|---|---|
| CN | 102628635 | 10/2014 | ..... | F25J 3/08 |
| DE | 1960515 | 5/1971 | ..... | F25J 1/02 |

(Continued)

OTHER PUBLICATIONS

United States Environmental Protection Agency (EPA), Overview of Greenhouse Gases, Oct. 31, 2018 (Year: 2018).*

(Continued)

*Primary Examiner* — Edward F Landrum
*Assistant Examiner* — Chang H. Park
(74) *Attorney, Agent, or Firm* — ExxonMobil Upstream Research Company-Law Department

(57) ABSTRACT

Described herein are systems and processes to produce liquefied natural gas (LNG) using liquefied nitrogen (LIN) as the refrigerant. Greenhouse gas contaminants are removed from the LIN using a greenhouse gas removal unit.

23 Claims, 10 Drawing Sheets

(52) U.S. Cl.
CPC ..... *F25J 2200/02* (2013.01); *F25J 2200/40* (2013.01); *F25J 2200/76* (2013.01); *F25J 2205/02* (2013.01); *F25J 2210/60* (2013.01); *F25J 2220/44* (2013.01); *F25J 2230/30* (2013.01); *F25J 2230/42* (2013.01); *F25J 2240/44* (2013.01); *F25J 2270/904* (2013.01); *F25J 2280/02* (2013.01)

(58) Field of Classification Search
CPC ..... F25J 1/025; F25J 2200/02; F25J 2200/40; F25J 2200/74; F25J 2200/76; F25J 2205/02; F25J 2210/42; F25J 2210/60; F25J 2215/02; F25J 2215/04; F25J 2215/42; F25J 2220/44; F25J 2230/08; F25J 2230/30; F25J 2230/42; F25J 2230/60; F25J 2235/42; F25J 2240/02; F25J 2240/44; F25J 2245/02; F25J 2260/20; F25J 2270/14; F25J 2270/16; F25J 2270/58; F25J 2270/904; F25J 2280/02; F25J 3/0233; F25J 3/0257; F25J 3/08; F25J 2220/04; F25J 2220/40; F25J 2220/52; F25J 2200/72; F25J 1/0224; F25J 1/0236; F25J 1/0237; F25J 2220/62; F25J 2270/42; F25J 1/005; F25J 1/0052; F25J 1/0208
See application file for complete search history.

(56) References Cited

U.S. PATENT DOCUMENTS

| | | | | |
|---|---|---|---|---|
| 3,370,435 | A | 2/1968 | Arregger | 62/28 |
| 3,400,547 | A | 9/1968 | Williams et al. | 62/55 |
| 3,690,114 | A * | 9/1972 | Swearingen | F25J 1/0022 62/613 |
| 3,724,226 | A | 4/1973 | Pachaly | 62/39 |
| 3,878,689 | A | 4/1975 | Grenci | 62/9 |
| 4,415,345 | A | 11/1983 | Swallow | 62/28 |
| 4,677,827 | A * | 7/1987 | Shenoy | F01K 25/10 60/648 |
| 5,025,860 | A | 6/1991 | Mandrin | 166/267 |
| 5,100,635 | A * | 3/1992 | Krishnamurthy | C01B 3/025 423/235 |
| 5,137,558 | A | 8/1992 | Agrawal | 62/24 |
| 5,139,547 | A | 8/1992 | Agrawal et al. | 62/8 |
| 5,141,543 | A | 8/1992 | Agrawal et al. | 62/8 |
| 5,638,698 | A | 6/1997 | Knight et al. | 62/632 |
| 5,950,453 | A | 9/1999 | Bowen et al. | 62/612 |
| 6,003,603 | A | 12/1999 | Breivik et al. | 166/357 |
| 6,295,838 | B1 | 10/2001 | Shah et al. | 62/643 |
| 6,298,688 | B1 | 10/2001 | Brostow et al. | 62/613 |
| 6,412,302 | B1 | 7/2002 | Foglietta | 62/611 |
| 6,662,589 | B1 | 12/2003 | Roberts et al. | 62/425 |
| 6,889,522 | B2 | 5/2005 | Prible et al. | 62/612 |
| 7,143,606 | B2 | 12/2006 | Tranier | 62/611 |
| 7,278,281 | B2 | 10/2007 | Yang et al. | 62/612 |
| 7,386,996 | B2 | 6/2008 | Fredheim et al. | 62/612 |
| 7,520,143 | B2 | 4/2009 | Spilsbury | 62/620 |
| 8,079,321 | B2 | 12/2011 | Balasubramanian | 114/74 |
| 8,435,403 | B2 | 5/2013 | Sapper et al. | 208/254 |
| 8,464,289 | B2 | 6/2013 | Pan | 725/34 |
| 8,601,833 | B2 | 12/2013 | Dee et al. | 62/648 |
| 8,616,012 | B2 | 12/2013 | Duerr et al. | 62/89 |
| 8,646,289 | B1 | 2/2014 | Shivers, III et al. | 62/611 |
| 9,422,037 | B2 | 8/2016 | VanWijngaarden et al. | 114/74 |
| 9,435,229 | B2 | 9/2016 | Alekseev et al. | 60/643 |
| 2006/0000615 | A1 | 1/2006 | Choi | 166/352 |
| 2008/0000266 | A1 | 1/2008 | Dee et al. | 62/643 |
| 2009/0217701 | A1 | 9/2009 | Minta et al. | 62/612 |
| 2010/0192626 | A1 | 8/2010 | Chantant | 62/606 |
| 2010/0251763 | A1 * | 10/2010 | Audun | B63B 25/16 62/614 |
| 2010/0319361 | A1 | 12/2010 | Chantant et al. | 62/50.2 |
| 2011/0036121 | A1 * | 2/2011 | Roberts | F25J 1/0022 62/612 |
| 2011/0126451 | A1 | 6/2011 | Pan et al. | 44/451 |
| 2011/0259044 | A1 | 10/2011 | Baudat et al. | 62/611 |
| 2012/0103010 | A1 | 5/2012 | Butts | 62/613 |
| 2012/0285196 | A1 | 11/2012 | Flinn et al. | 62/620 |
| 2013/0199238 | A1 | 8/2013 | Mock et al. | 62/611 |
| 2014/0130542 | A1 | 5/2014 | Brown | 62/612 |
| 2015/0114034 | A1 * | 4/2015 | Higginbotham | B01D 53/002 62/617 |
| 2017/0010041 | A1 | 1/2017 | Pierre, Jr. et al. | 62/616 |
| 2017/0016668 | A1 | 1/2017 | Pierre, Jr. et al. | 62/614 |

FOREIGN PATENT DOCUMENTS

| | | | |
|---|---|---|---|
| DE | 2354726 | 5/1975 | F17C 9/04 |
| DE | 102013007208 | 10/2014 | B01D 3/14 |
| EP | 1972875 | 9/2008 | F25J 3/04 |
| FR | 2756368 | 5/1998 | B01D 53/26 |
| GB | 1376678 | 12/1974 | F25J 1/02 |
| GB | 1596330 | 8/1981 | F25J 1/02 |
| GB | 2172388 | 9/1986 | E21B 43/16 |
| GB | 2333148 | 7/1999 | F25J 1/02 |
| GB | 2470062 | 11/2010 | F25J 1/02 |
| GB | 2486036 | 11/2012 | F25J 1/02 |
| JP | S59216785 | 12/1984 | F17C 13/00 |
| WO | WO2006/120127 | 11/2006 | F25J 3/02 |
| WO | WO2014/078092 | 5/2014 | C10L 3/10 |
| WO | WO2015/110443 | 7/2015 | F25J 1/00 |

OTHER PUBLICATIONS

The Engineering Toolbox, Nitrogen—Density and Specific Weight, 2018 (Year: 2018).*
U.S. Appl. No. 15/347,968, filed Nov. 10, 2016, Pierre, Fritz Jr. et al.
U.S. Appl. No. 15/347,983, filed Nov. 10, 2016, Pierre, Fritz Jr. et al.
U.S. Appl. No. 15/348,004, filed Nov. 10, 2016, Pierre, Fritz Jr. et al.
U.S. Appl. No. 15/348,533, filed Nov. 10, 2016, Pierre, Fritz Jr.
U.S. Appl. No. 62/458,127, filed Feb. 13, 2017, Pierre, Fritz Jr.
U.S. Appl. No. 62/458,131, filed Feb. 13, 2017, Pierre, Fritz Jr.
U.S. Appl. No. 62/463,274, filed Feb. 24, 2017, Kaminsky, Robert D. et al.
U.S. Appl. No. 62/478,961, Balasubramanian, Sathish.
Publication No. 43031 (2000) Research Disclosure, Mason Publications, Hampshire, GB, Feb. 1, 2000, p. 239, XP000969014, ISSN: 0374-4353, paragraphs [0004], [0005] & [0006].
Publication No. 37752 (1995) Research Disclosure, Mason Publications, Hampshire, GB, Sep. 1, 1995, p. 632, XP000536225, ISSN: 0374-4353, 1 page.
Bach, Wilfried (1990) "Offshore Natural Gas Liquefaction with Nitrogen Cooling—Process Design and Comparison of Coil-Wound and Plate-Fin Heat Exchangers," *Science and Technology Reports*, No. 64, Jan. 1, 1990, pp. 31-37.

* cited by examiner

LIQUEFIED NATURAL GAS PRODUCTION SYSTEM AND METHOD WITH GREENHOUSE GAS REMOVAL

CROSS-REFERENCE TO RELATED APPLICATIONS

This application claims the priority benefit of U.S. Patent Application No. 62/192,654 filed Jul. 15, 2015 entitled LIQUEFIED NATURAL GAS PRODUCTION SYSTEM AND METHOD WITH GREENHOUSE GAS REMOVAL, the entirety of which is incorporated by reference herein.

This application is related to the U.S. Provisional Patent Application No. 62/192,657 entitled "INCREASING EFFICIENCY IN AN LNG PRODUCTION SYSTEM BY PRE-COOLING A NATURAL GAS FEED STREAM," having common inventors and assignee and filed on an even date herewith, the disclosure of which is incorporated by reference herein in its entirety.

FIELD OF THE INVENTION

The invention relates to the liquefaction of natural gas to form liquefied natural gas (LNG), and more specifically, to the production of LNG in remote or sensitive areas where the construction and/or maintenance of capital facilities, and/or the environmental impact of a conventional LNG plant may be detrimental.

BACKGROUND

LNG production is a rapidly growing means to supply natural gas from locations with an abundant supply of natural gas to distant locations with a strong demand of natural gas. The conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form LNG at near atmospheric pressure and about −160° C.; d) transport of the LNG product in ships or tankers designed for this purpose to a market location; e) re-pressurization and re-gasification of the LNG to a pressurized natural gas that may distributed to natural gas consumers. Step (c) of the conventional LNG cycle usually requires the use of large refrigeration compressors often powered by large gas turbine drivers that emit substantial carbon and other emissions. Large capital investments in the billions of US dollars and extensive infrastructure are required as part of the liquefaction plant. Step (e) of the conventional LNG cycle generally includes re-pressurizing the LNG to the required pressure using cryogenic pumps and then re-gasifying the LNG to pressurized natural gas by exchanging heat through an intermediate fluid but ultimately with seawater or by combusting a portion of the natural gas to heat and vaporize the LNG. Generally, the available exergy of the cryogenic LNG is not utilized.

A cold refrigerant produced at a different location, such as liquefied nitrogen gas ("LIN"), can be used to liquefy natural gas. A process known as the LNG-LIN concept relates to a non-conventional LNG cycle in which at least Step (c) above is replaced by a natural gas liquefaction process that substantially uses liquid nitrogen (LIN) as an open loop source of refrigeration and in which Step (e) above is modified to utilize the exergy of the cryogenic LNG to facilitate the liquefaction of nitrogen gas to form LIN that may then be transported to the resource location and used as a source of refrigeration for the production of LNG. U.S. Pat. No. 3,400,547 describes shipping liquid nitrogen or liquid air from a market place to a field site where it is used to liquefy natural gas. U.S. Pat. No. 3,878,689 describes a process to use LIN as the source of refrigeration to produce LNG. U.S. Pat. No. 5,139,547 describes the use of LNG as a refrigerant to produce LIN.

The LNG-LIN concept further includes the transport of LNG in a ship or tanker from the resource location to the market location and the reverse transport of LIN from the market location to the resource location. The use of the same ship or tanker, and perhaps the use of common onshore tankage, are expected to minimize costs and required infrastructure. As a result, some contamination of the LNG with LIN and some contamination of the LIN with LNG may be expected. Contamination of the LNG with LIN is likely not to be a major concern as natural gas specifications (such as those promulgated by the United States Federal Energy Regulatory Commission) for pipelines and similar distribution means allow for some inert gas to be present. However, since the LIN at the resource location will ultimately be vented to the atmosphere, contamination of the LIN with LNG (a greenhouse gas more than 20 times as impactful as Carbon Dioxide) must be reduced to levels acceptable for such venting. Techniques to remove the residual contents of tanks are well known but it may not be economic or environmentally acceptable to achieve the needed low level of contamination to avoid treatment of the LIN or vaporized nitrogen at the resource location prior to venting the gaseous nitrogen (GAN).

United States Patent Application Publication No. 2010/0251763 describes a variation of the LNG liquefaction process using both LIN and liquefied carbon dioxide ($CO_2$) as refrigerants. While $CO_2$ is itself a greenhouse gas, it is less likely that liquefied $CO_2$ will share storage or transport facilities with LNG or other greenhouse gases and so contamination is unlikely. However, the LIN may be similarly contaminated as described above and should be decontaminated prior to venting of the resulting GAN streams. In addition, the LNG liquefaction system may be supplemented by pre-chilling of the natural gas with a propane, mixed component or other closed refrigeration cycle in addition to the once-through refrigeration provided by vaporization of the LIN. In these cases, decontamination of the gaseous nitrogen may still be required prior to venting the GAN. What is needed is a method of using LIN as a coolant to produce LNG, where if the LIN and the LNG use common storage facilities, any greenhouse gas present in the LIN can be efficiently removed.

SUMMARY OF THE INVENTION

The invention provides a liquefied natural gas production system using liquid nitrogen as a primary refrigerant. A natural gas stream is supplied from a natural gas supply, and a liquefied nitrogen stream is supplied from a liquefied nitrogen supply. At least one heat exchanger exchanges heat between the liquefied nitrogen stream and the natural gas stream to at least partially vaporize the liquefied nitrogen stream and at least partially condense the natural gas stream. A greenhouse gas removal unit removes greenhouse gas from the at least partially vaporized nitrogen stream.

The invention also provides a method of producing liquefied natural gas (LNG) using liquid nitrogen as a primary refrigerant. A natural gas stream is provided from a supply of natural gas. A liquefied nitrogen stream is provided from a supply of liquefied nitrogen. The natural gas stream and the liquefied nitrogen stream are passed through a first heat exchanger that exchanges heat between the liquefied nitrogen stream and the natural gas stream to at least partially vaporize the liquefied nitrogen stream and at least partially condense the natural gas stream. Greenhouse gas is removed from the at least partially vaporized nitrogen stream using a greenhouse gas removal unit.

The invention further provides a method of removing greenhouse gas contaminants in a liquid nitrogen stream used to liquefy a natural gas stream. The natural gas stream and the liquefied nitrogen stream are passed through a first heat exchanger that exchanges heat between the liquefied nitrogen stream and the natural gas stream to at least partially vaporize the liquefied nitrogen stream and at least partially condense the natural gas stream. The liquefied nitrogen stream is circulated through the first heat exchanger at least three times. A pressure of the at least partially vaporized nitrogen stream is reduced using at least one expander service. A greenhouse gas removal unit is provided that includes a distillation column and heat pump condenser and reboiler system. The pressure and condensing temperature of an overhead stream of the distillation column are increased. The overhead stream of the distillation column is cross-exchanged with a bottoms stream of the distillation column to affect both an overhead condenser duty and a bottom reboiler duty of the distillation column. The pressure of the distillation column overhead stream is reduced after the cross-exchanging step to produce a reduced-pressure distillation column overhead stream. The reduced-pressure distillation column overhead stream is separated to produce a first separator overhead stream. The first separator overhead stream is gaseous nitrogen that exits the greenhouse gas removal unit having greenhouse gases removed therefrom. The first separator overhead stream is vented to atmosphere.

DETAILED DESCRIPTION

Figure 1:
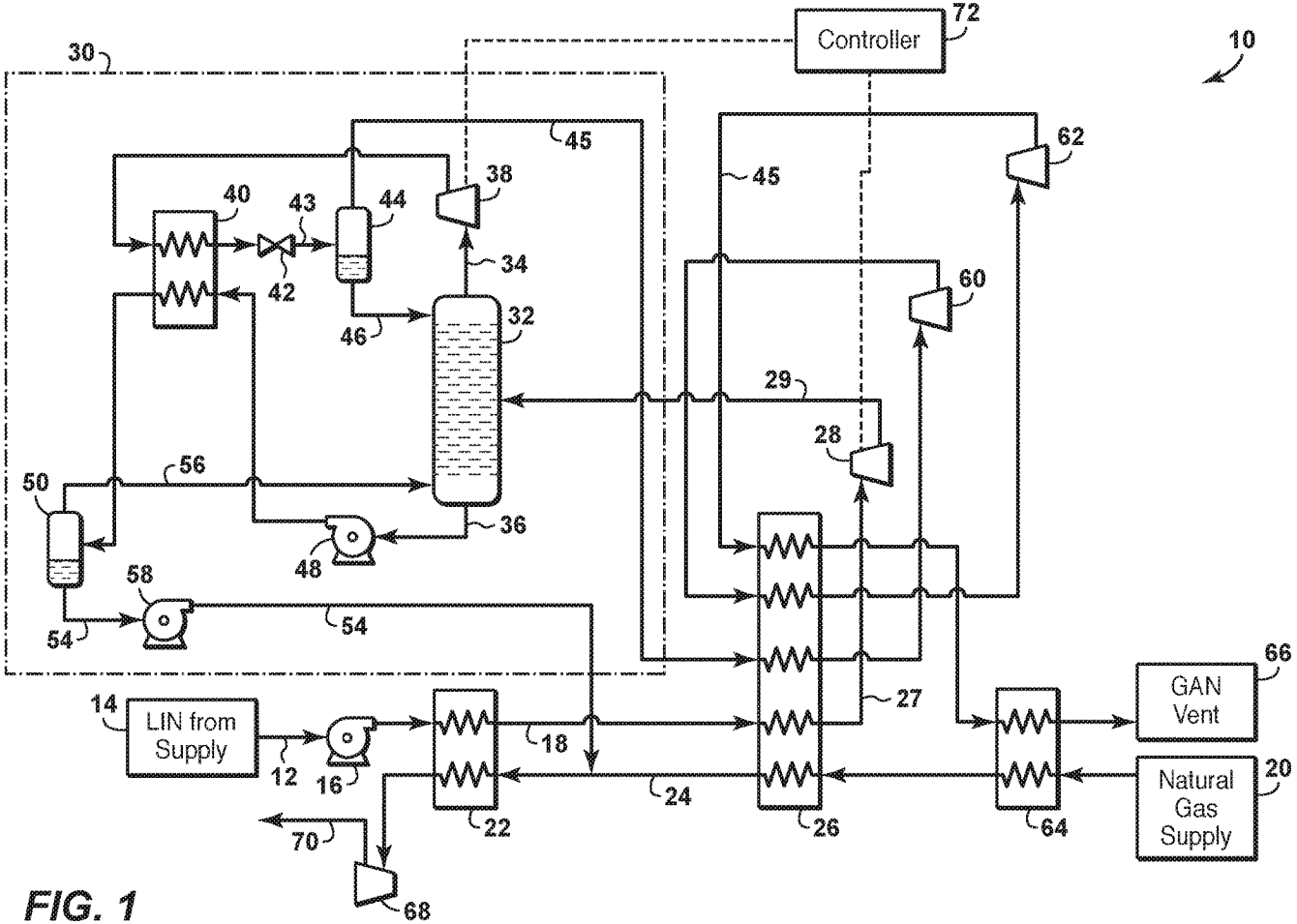
FIG. 1 is a schematic diagram of a system to liquefy natural gas to form LNG using liquid nitrogen as the sole refrigerant.

Various specific embodiments and versions of the present invention will now be described, including preferred embodiments and definitions that are adopted herein. While the following detailed description gives specific preferred embodiments, those skilled in the art will appreciate that these embodiments are exemplary only, and that the present invention can be practiced in other ways. Any reference to the "invention" may refer to one or more, but not necessarily all, of the embodiments defined by the claims. The use of headings is for purposes of convenience only and does not limit the scope of the present invention. For purposes of clarity and brevity, similar reference numbers in the several Figures represent similar items, steps, or structures and may not be described in detail in every Figure.

All numerical values within the detailed description and the claims herein are modified by "about" or "approximately" the indicated value, and take into account experimental error and variations that would be expected by a person having ordinary skill in the art.

As used herein, the term "compressor" means a machine that increases the pressure of a gas by the application of work. A "compressor" or "refrigerant compressor" includes any unit, device, or apparatus able to increase the pressure of a gas stream. This includes compressors having a single compression process or step, or compressors having multi-stage compressions or steps, or more particularly multi-stage compressors within a single casing or shell. Evaporated streams to be compressed can be provided to a compressor at different pressures. Some stages or steps of a cooling process may involve two or more compressors in parallel, series, or both. The present invention is not limited by the type or arrangement or layout of the compressor or compressors, particularly in any refrigerant circuit.

As used herein, "cooling" broadly refers to lowering and/or dropping a temperature and/or internal energy of a substance by any suitable, desired, or required amount. Cooling may include a temperature drop of at least about 1° C., at least about 5° C., at least about 10° C., at least about 15° C., at least about 25° C., at least about 35° C., or least about 50° C., or at least about 75° C., or at least about 85° C., or at least about 95° C., or at least about 100° C. The cooling may use any suitable heat sink, such as steam generation, hot water heating, cooling water, air, refrigerant, other process streams (integration), and combinations thereof. One or more sources of cooling may be combined and/or cascaded to reach a desired outlet temperature. The cooling step may use a cooling unit with any suitable device and/or equipment. According to some embodiments, cooling may include indirect heat exchange, such as with one or more heat exchangers. In the alternative, the cooling may use evaporative (heat of vaporization) cooling and/or direct heat exchange, such as a liquid sprayed directly into a process stream.

As used herein, the term "expansion device" refers to one or more devices suitable for reducing the pressure of a fluid in a line (for example, a liquid stream, a vapor stream, or a multiphase stream containing both liquid and vapor). Unless a particular type of expansion device is specifically stated, the expansion device may be (1) at least partially by isenthalpic means, or (2) may be at least partially by isentropic means, or (3) may be a combination of both isentropic means and isenthalpic means. Suitable devices for isenthalpic expansion of natural gas are known in the art and generally include, but are not limited to, manually or automatically, actuated throttling devices such as, for example, valves, control valves, Joule-Thomson (J-T) valves, or venturi devices. Suitable devices for isentropic expansion of natural gas are known in the art and generally include equipment such as expanders or turbo expanders that extract or derive work from such expansion. Suitable devices for isentropic expansion of liquid streams are known in the art and generally include equipment such as expanders, hydraulic expanders, liquid turbines, or turbo expanders that extract or derive work from such expansion. An example of a combination of both isentropic means and isenthalpic means may be a Joule-Thomson valve and a turbo expander in parallel, which provides the capability of using either alone or using both the J-T valve and the turbo expander simultaneously. Isenthalpic or isentropic expansion can be conducted in the all-liquid phase, all-vapor phase, or mixed phases, and can be conducted to facilitate a phase change from a vapor stream or liquid stream to a multiphase stream (a stream having both vapor and liquid phases) or to a single-phase stream different from its initial phase. In the description of the drawings herein, the reference to more than one expansion device in any drawing does not necessarily mean that each expansion device is the same type or size.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

A "heat exchanger" broadly means any device capable of transferring heat energy or cold energy from one medium to another medium, such as between at least two distinct fluids. Heat exchangers include "direct heat exchangers" and "indirect heat exchangers." Thus, a heat exchanger may be of any suitable design, such as a co-current or counter-current heat exchanger, an indirect heat exchanger (e.g. a spiral wound heat exchanger or a plate-fin heat exchanger such as a brazed aluminum plate fin type), direct contact heat exchanger, shell-and-tube heat exchanger, spiral, hairpin, core, core-and-kettle, printed-circuit, double-pipe or any other type of known heat exchanger. "Heat exchanger" may also refer to any column, tower, unit or other arrangement adapted to allow the passage of one or more streams therethrough, and to affect direct or indirect heat exchange between one or more lines of refrigerant, and one or more feed streams.

As used herein, the term "indirect heat exchange" means the bringing of two fluids into heat exchange relation without any physical contact or intermixing of the fluids with each other. Core-in-kettle heat exchangers and brazed aluminum plate-fin heat exchangers are examples of equipment that facilitate indirect heat exchange.

As used herein, the term "natural gas" refers to a multicomponent gas obtained from a crude oil well (associated gas) or from a subterranean gas-bearing formation (non-associated gas). The composition and pressure of natural gas can vary significantly. A typical natural gas stream contains methane ($C_1$) as a significant component. The natural gas stream may also contain ethane ($C_2$), higher molecular weight hydrocarbons, and one or more acid gases. The natural gas may also contain minor amounts of contaminants such as water, nitrogen, iron sulfide, wax, and crude oil.

Certain embodiments and features have been described using a set of numerical upper limits and a set of numerical lower limits. It should be appreciated that ranges from any lower limit to any upper limit are contemplated unless otherwise indicated. All numerical values are "about" or "approximately" the indicated value, and take into account experimental error and variations that would be expected by a person having ordinary skill in the art.

All patents, test procedures, and other documents cited in this application are fully incorporated by reference to the extent such disclosure is not inconsistent with this application and for all jurisdictions in which such incorporation is permitted.

Described herein are systems and processes relating to the natural gas liquefaction process using once-through LIN as a primary refrigerant to remove a substantial portion of residual LNG contamination of the LIN prior to venting of the gaseous hydrogen. Specific embodiments of the invention include those set forth in the following paragraphs as described with reference to the Figures. While some features are described with particular reference to only one Figure (such as FIG. 1, 2, or 3), they may be equally applicable to the other Figures and may be used in combination with the other Figures or the foregoing discussion.

FIG. 1 shows a system 10 to liquefy natural gas to produce LNG using liquid nitrogen (LIN) as the sole external refrigerant. System 10 may be termed an LNG production system. A LIN stream 12 is received from a LIN supply system 14, which may comprise one or more tankers, tanks, pipelines, or a combination thereof. The LIN supply system 14 may be in alternating service between LIN storage and LNG storage. LIN stream 12 may be contaminated with a greenhouse gas such as methane, ethane, propane or other alkanes or alkenes. LIN stream 12 may be contaminated approximately 1% by volume with greenhouse gases, although the level of contamination may vary based on the methods used to empty and purge the LIN supply system before switching between LIN storage and LNG storage. LIN stream 12 is supplied at or near atmospheric pressure at a temperature of about −196° C., which is near the atmospheric boiling point of nearly pure nitrogen. The LIN stream 12 is sent through a LIN pump 16, which increases the pressure of the LIN between approximately 20 bara and 200 bara with a preferred pressure of about 90 bara. This pumping process may increase the temperature of the LIN within the LIN stream 12, but it is expected the LIN will remain substantially in liquid form. The pressurized LIN stream 18 then flows through a series of heat exchangers and expanders to remove heat from the incoming natural gas supply 20 to condense the natural gas to LNG. Still referring to FIG. 1, the pressurized LIN stream 18 flows through a first heat exchanger 22 where it cools a natural gas stream 24. The pressurized LIN stream 18 then flows a first time through a second heat exchanger 26 where it again cools the natural gas stream.

After the LIN passes through the first heat exchanger 22 and the second heat exchanger 26, it is expected that the LIN and any greenhouse gas contaminants will be fully vaporized to form a contaminated gaseous nitrogen (cGAN) stream 27. As the gaseous nitrogen is processed as further described, it may not be fully vaporized even though it is described herein as gaseous nitrogen or cGAN. For the sake of simplicity any mixture of gaseous and partially condensed nitrogen is still noted as cGAN or gaseous nitrogen.

The cGAN stream 27 is directed to a first expander 28. The output stream of the first expander 28, which is an expanded cGAN stream 29, is directed a greenhouse gas removal unit 30. The pressure of the expanded cGAN stream 29 may range from 5 bara to 30 bara based largely upon the phase envelope of the cGAN mixture, which typically is a mixture of nitrogen, methane, ethane, propane and other potential greenhouse gases. In one aspect, the pressure of the expanded cGAN stream 29 is between 19 and 20 bara and the temperature of the expanded cGAN stream 29 is about −153 degrees Celsius. However, the pressure of the expanded cGAN stream may be as low as 1 bara if alternative removal technologies, such as adsorption, absorption, or catalytic processes are used.

The greenhouse gas removal unit 30 may be required to produce a GAN stream with greenhouse gas content of less than 500 ppm, or less than 200 ppm, or less than 100 ppm, or less than 50 ppm, or less than 20 ppm. The greenhouse gas removal unit 30 may be required to produce a greenhouse gas product stream with a nitrogen content of less than 80%, or less than 50%, or less than 20%, or less than 10%, or less than 5%.

The greenhouse gas removal unit 30 may include a partially refluxed and partially re-boiled distillation column 32. The distillation column 32 separates the gaseous nitrogen from the greenhouse gas contaminants based on the differences in vaporization temperatures of nitrogen and the greenhouse gases. The outputs of the distillation column are an overhead stream 34, which is a decontaminated gaseous nitrogen stream, and a bottoms product, which is a greenhouse gas product stream 36. Side-re-boilers, side condensers and intermediate draws (not shown) may be included to remove products at other locations in the distillation column 32.

The greenhouse gas removal unit 30 may include an overhead condenser associated with the distillation column 32 and having a cooling duty supplied by heat exchange with LIN, GAN, cGAN, natural gas or LNG sources from other parts of the LNG Production System, or even from a supplemental refrigeration system. Similarly, the greenhouse gas removal unit may include a bottoms reboiler associated with the distillation column 32 and having a heating duty supplied by heat exchange with LIN, GAN, cGAN, natural gas or LNG from other parts of the LNG Production System or another process external to the LNG Production System. The disadvantage of these types of arrangements is the adverse impact of the largely condensing and largely boiling-type heating requirements of the distillation column condenser and reboiler on the overall heating and cooling curves to condense the natural gas to LNG. These impacts may result in temperature pinches in the heat exchangers that diminish the effectiveness of the available LIN supply. According to the invention, the condenser and reboiler cooling and heating duties are cross-exchanged such that the cold duty available from the reboiler is used to meet the hot duty required of the condenser. To accomplish this, a heat pump condenser and reboiler system is used to increase the pressure of the distillation column overhead stream 34 such that the temperature of the compressed overhead stream is higher than the temperature of the greenhouse gas product stream 36. Specifically, the heat pump condenser and reboiler system comprises an overhead compressor 38 that compresses and warms the overhead stream 34, a heat pump heat exchanger 40 that cools the overhead stream and warms the greenhouse gas product stream, and a pressure reduction device 42 that reduces the pressure of the cooled overhead stream and reduces its pressure. The pressure reduction device 42 may be a Joule-Thomson valve or a turbo-expander. At this point the overhead stream has become a partially condensed overhead stream 43. If desired, a first separator 44 may be used to separate the partially condensed overhead stream 43 to form an overhead product stream 45 and a column reflux stream 46. The overhead product stream 45, being the overhead product of both the distillation column 32 and the first separator 44, is comprised of GAN substantially decontaminated of greenhouse gases such as methane, ethane, etc., and exits the greenhouse gas removal unit 30 for further heat exchange operations and venting as will be described herein. Because the column reflux stream 46 may include some greenhouse gases, the column reflux stream is sent back to the distillation column 32 for further separation steps.

The other portion of the heat pump condenser and reboiler system may include a bottoms pump 48 to deliver the greenhouse gas product stream 36 to the heat pump heat exchanger 40 at an increased pressure. After being heated in the heat pump heat exchanger 40, the greenhouse gas product stream 36 is now partially vaporized and may be sent to a second separator 50, which separates the partially vaporized greenhouse gas product stream to form a separated greenhouse gas product stream 54 and a column reboiler vapor stream 56. A greenhouse gas pump 58 may be used to deliver the separated greenhouse gas product stream 54 to another location in system 10 at a required pressure. In the embodiment shown in FIG. 1, the separated greenhouse gas product stream 54 is mixed with the natural gas stream 24 after the natural gas stream 24 has passed through the second heat exchanger 26 to be included in the LNG product stream of system 10. The column reboiler stream 56, which may include a portion of GAN, is returned to the distillation column 32 for further separation steps.

The overhead product stream 45, which is substantially decontaminated GAN, exits the greenhouse gas removal unit 30 and passes iteratively through the second heat exchanger 26 and second and third expanders 60, 62 to further cool the natural gas stream 24. In FIG. 1 three expanders are shown, which function as a high-pressure expander (28), a medium-pressure expander (60), and a low pressure expander (62), each expander reducing the pressure of the nitrogen stream respectively passing therethrough. In an embodiment the first, second, and third expanders 28, 60, 62 are turbo expanders. The expanders may be radial inflow turbines, partial admission axial flow turbines, full admission axial flow turbines, reciprocating engines, helical screw turbines or similar expansion devices. The expanders may be separate machines or combined into one or more machines with common outputs. The expanders may be designed to drive generators, compressors, pumps, water brakes or any similar power-consuming device to remove the energy from the system 10. The expanders may be used to directly drive (or drive via gearboxes or other transmission devices) pumps, compressors and other machines used within the system 10. In an embodiment, each expander is an expander service, wherein expansion may be performed by one or more individual expander devices acting in parallel or series or a combination of parallel and series operation. At least one expander or expander service is required to economically operate system 10 and generally at least two expander services are preferred. More than three expander services may also be used in this system to possibly further improve the effectiveness of the refrigeration by the available LIN supply.

After passing through the third expander 62 and the second heat exchanger 26 for the final time, the overhead product stream 45 passes through a third heat exchanger 64 that cools the natural gas stream 24 an additional time. The overhead product stream, which as previously stated is GAN, is vented to the atmosphere at GAN vent 66 or is otherwise disposed of. If the GAN is vented, the GAN plume should be sufficiently buoyant to be widely distributed and diluted by the atmosphere prior to any significant part of the plume returning to near ground level, which may cause a potentially hazardous oxygen deficiency. Since the GAN is likely to have essentially zero relative humidity and a specific gravity only slightly less than the ambient air, embodiments should ensure GAN vent temperatures greater than the local ambient temperature to improve buoyancy and promote dispersal of the GAN plume. Those skilled in the art of vent and vent stack design are aware of alternatives to temperature to improve plume dispersal, including modifying stack height and providing a higher velocity stack exit that, as an example, may be provided by a venturi feature as part of the stack design.

The path of natural gas through system 10 will now be described. The natural gas supply 20 is received at pressure, or is compressed to a desired pressure, and then flows through various heat exchangers in series, parallel or a combination of series and parallel to be cooled by the refrigerant or refrigerants. The natural gas pressure supplied to the system 10 is typically between 20 bara and 100 bara with the upper pressure generally limited by the economic selection of heat exchange equipment. With future advances in heat exchanger design, supply pressure of 200 bara or more may be feasible. In a preferred embodiment, the natural gas supply pressure is selected at about 90 bara. Those skilled in the art are aware that increasing the natural gas supply pressure generally improves the heat transfer effectiveness within an LNG liquefaction process. As shown in FIG. 1, natural gas from the natural gas supply 20 first flows through the third heat exchanger 64. The third heat exchanger pre-chills the natural gas before entering the second heat exchanger 26, which is the main heat exchanger of the system 10. The third heat exchanger also warms the GAN in the overhead product stream 45 to near the incoming temperature of the natural gas stream. The third heat exchanger 64 may be eliminated from system 10 if desired.

After exiting the first heat exchanger, the natural gas stream 24 is chilled and condensed at pressure in the second heat exchanger 26, where the natural gas stream is cooled by several passes of the GAN in the overhead product stream 45. The natural gas stream 24 is merged with the separated greenhouse gas product stream 54, which as previously described is greenhouse gases with substantially all GAN removed therefrom. The natural gas stream 24 then passes through the first heat exchanger 22, which uses LIN from the LIN supply system 14 to cool the natural gas stream 24. The first heat exchanger 22 may be eliminated from system 10 if desired. At this point the natural gas in the natural gas stream 24 has been substantially completely liquefied to form LNG. The condensed high pressure LNG is reduced to near ambient pressure through a pressure reduction device 68 that may comprise a single-phase or multi-phase hydraulic turbine, Joule-Thomson valve or a similar pressure reduction device. FIG. 1 shows the use of a hydraulic turbine. The LNG stream 70 exiting the pressure reduction device 68 may then be stored in tankage, delivered to a land-based or water-borne tanker, delivered to a suitable cryogenic pipeline or similar conveyance to ultimately deliver the LNG to a market location.

The distillation column 32 of the greenhouse gas removal unit 30 may be controlled to meet required specifications for greenhouse gas content of the overhead product stream 45 and the nitrogen content of the greenhouse gas product stream 36 and/or the separated greenhouse gas product stream 54. Generally, the temperature and fraction vaporized of the expanded cGAN stream 29 will affect the relative condenser and reboiler duties, with higher fraction vaporized or higher temperatures of the expanded cGAN stream 29 increasing the condenser duty while decreasing the reboiler duty at the same product specifications. Lower fraction vaporized or lower temperatures of the expanded cGAN stream 29 have the opposite effects. In addition, an increase (or decrease) of the heat transfer rate within the heat pump heat exchanger 40 tends to increase (or decrease) both the condenser and reboiler duties that affect the product specifications. A controller 72 to adjust both the temperature and/or fraction vaporized of the expanded cGAN stream 29 and the heat pump heat exchanger 40 heat transfer rate may be used to both balance the condenser and reboiler duties (with adjustments for the extra energy added by the overhead compressor 38) and the product specifications of the distillation column 32. In practice, these controls may be realized by adjusting the inlet temperature of the first turbo-expander 28 and by controlling the pressure increase of the column overhead compressor 38. Alternatively, other components of the system 10 may be controlled to achieve the same outcome.

Figure 2:
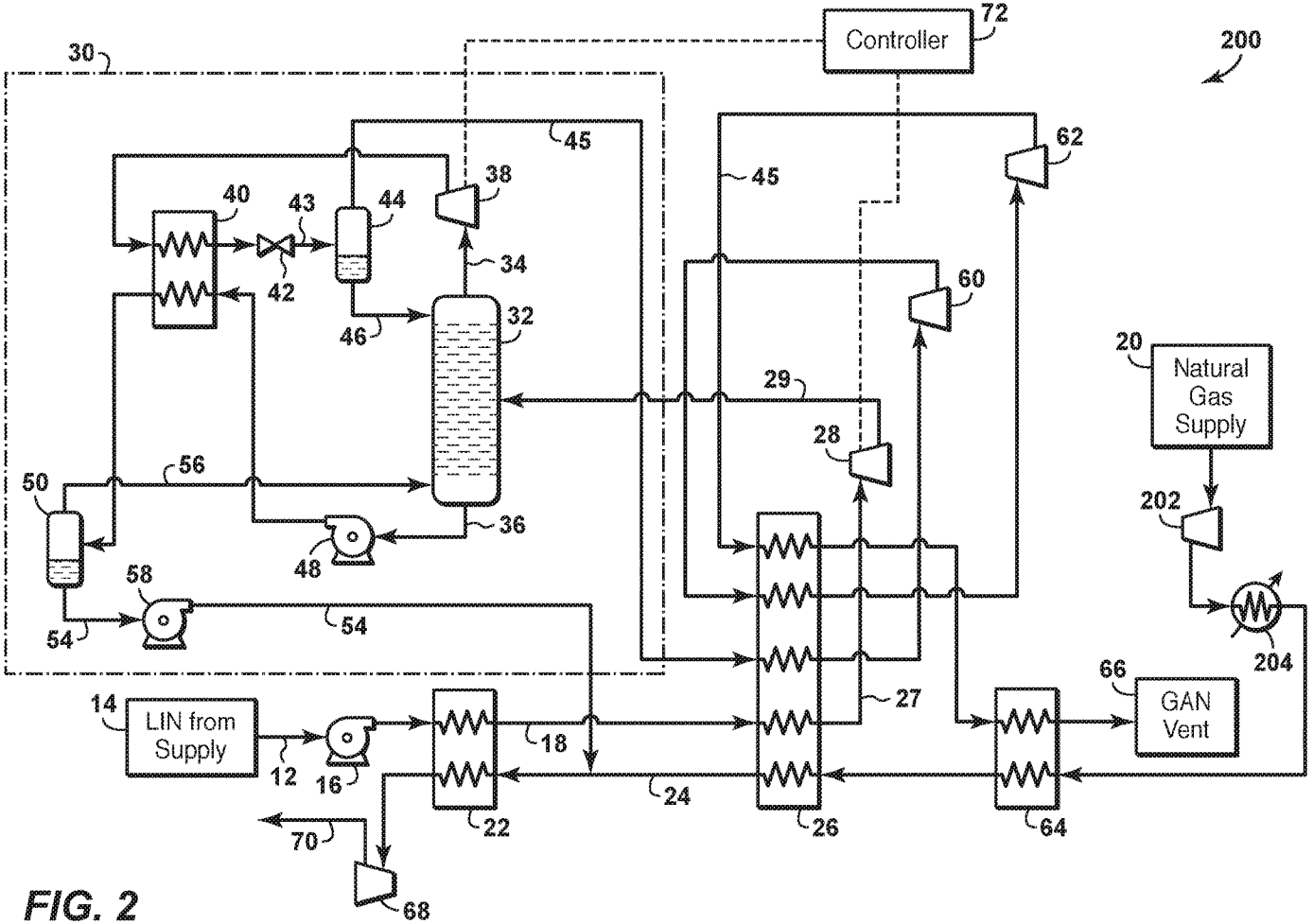
FIG. 2 is a schematic diagram of a system to liquefy natural gas to form LNG using liquid nitrogen as the sole refrigerant.

Having described an embodiment of the invention, additional aspects will now be described. FIG. 2 illustrates an LNG production system 200 similar to system 10 of FIG. 1. LNG production system 200 further includes a natural gas compressor 202 and a natural gas cooler 204 that are used to pressurize and cool the natural gas to an optimal pressure and temperature prior to entering the third, second, and first heat exchangers 64, 26, 22. The natural gas compressor 202 and the natural gas cooler 204 may be a plurality of individual compressors and coolers or a single compressor stage and cooler. The natural gas compressor 202 may be selected from compressor types generally known to those skilled in the art, including centrifugal, axial, screw and reciprocating type compressors. The natural gas cooler 204 may be selected from cooler types generally known to those skilled in the art, including air fin, double pipe, shell and tube, plate and frame, spiral wound, and printed circuit type heat exchangers. The natural gas supply pressure following the natural gas compressor 202 and the natural gas cooler 204 should be similar to the range noted previously (e.g. 20-100 bara and up to 200 bara or more as heat exchanger design advances).

Figure 3:
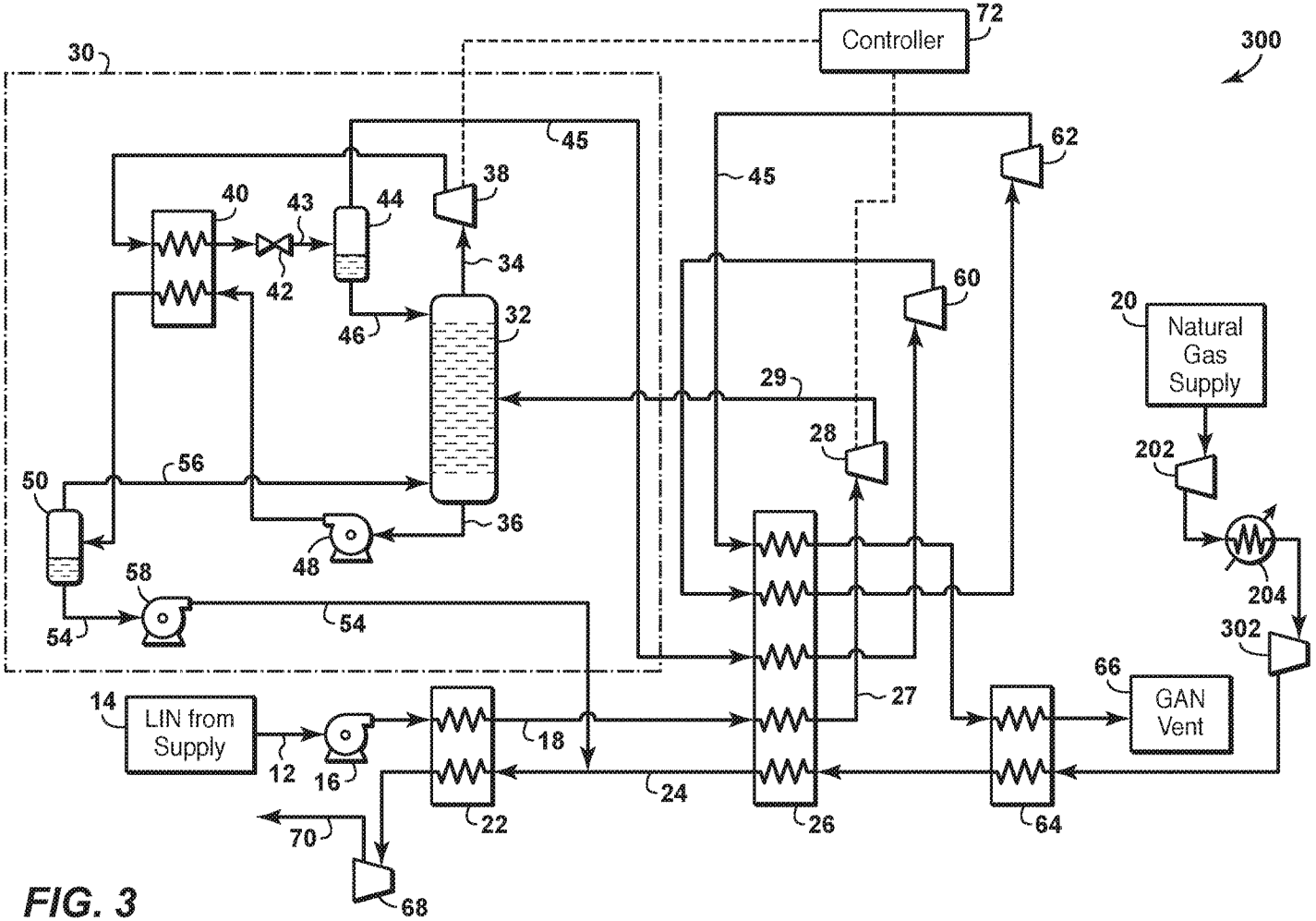
FIG. 3 is a schematic diagram of a system to liquefy natural gas to form LNG using liquid nitrogen as the sole refrigerant.

FIG. 3 illustrates an LNG production system 300 similar to LNG production system 200. LNG production system 300 adds a natural gas expander 302 following the natural gas compressor 202 and the natural gas cooler 204. The natural gas expander 302 may be any type of expander, such as a turbo-expander or another type of pressure reduction device such as a J-T valve. In LNG production system 300, the discharge pressure of the natural gas compressor 202 may be increased above the range indicated by an economic selection of heat exchange equipment and the excess pressure reduced through the natural gas expander 302. The combination of compression, cooling and expansion further pre-chills the natural gas supply prior to entering the third heat exchanger 64 or the second heat exchanger 26. For example, the natural gas compressor 202 may compress the natural gas supply to a pressure greater than 135 bara and the natural gas expander may reduce the pressure of the natural gas to less than 200 bara, but in no event greater than the pressure to which the natural gas compresses the natural gas. In an embodiment, the natural gas stream is compressed by the natural gas compressor to a pressure greater than 200 bara. In another embodiment, the natural gas expander expands the natural gas stream to a pressure less than 135 bara. However, the location of the third heat exchanger 64 downstream of the natural gas expander 302 (as shown in FIG. 3) significantly lowers the temperature of the GAN passing through the third heat exchanger 64. The temperature of the GAN so cooled may be well below the local ambient temperature, thereby complicating efforts to safely and/or efficiently vent the GAN to the atmosphere.

Figure 4:
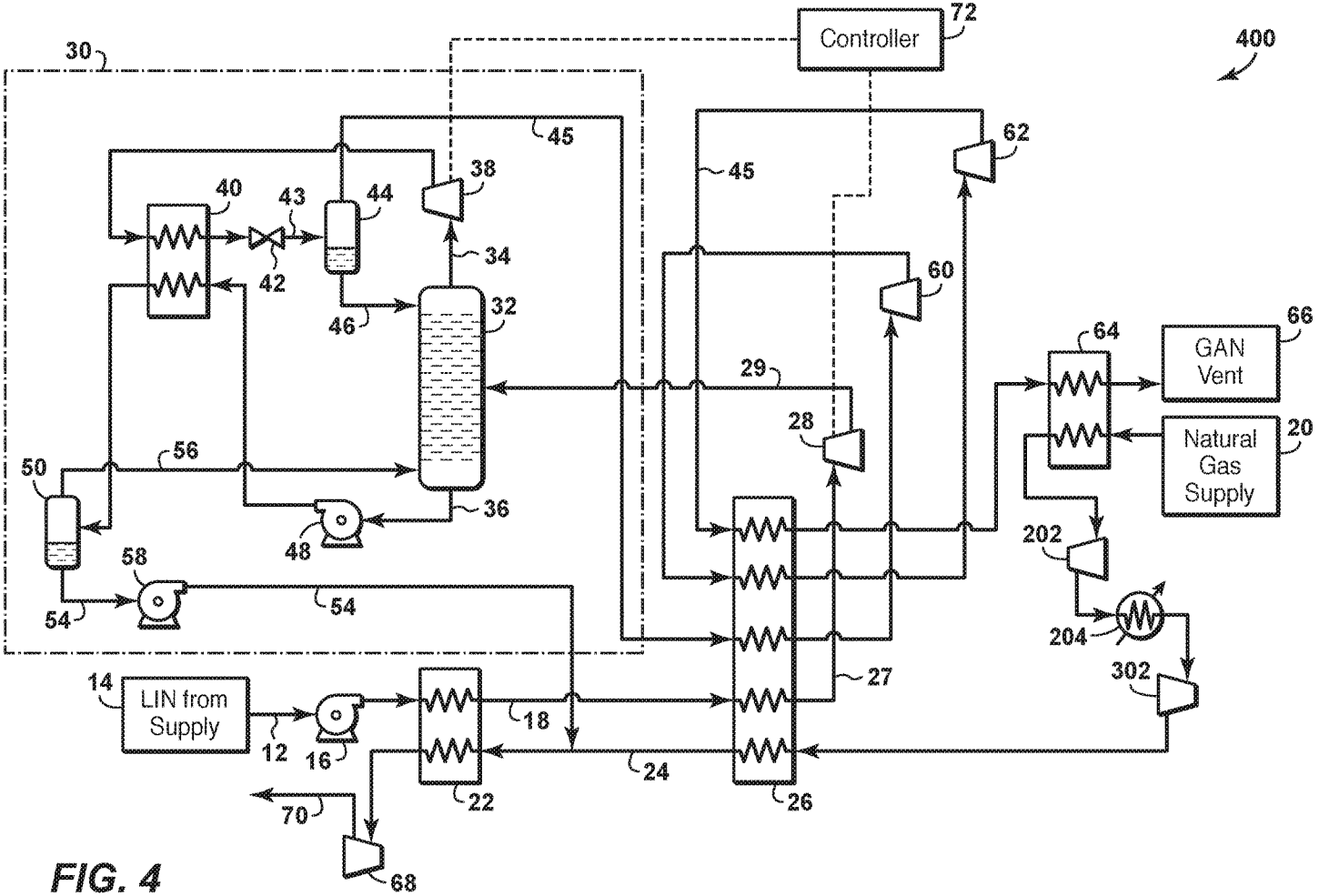
FIG. 4 is a schematic diagram of a system to liquefy natural gas to form LNG using liquid nitrogen as the sole refrigerant.

FIG. 4 illustrates an LNG production system 400 similar to LNG production system 300. In LNG production system 400, the third heat exchanger 64 is located so that natural gas from the natural gas supply 20 enters the third heat exchanger before passing through the natural gas compressor 202. Placing the third heat exchanger 64 as shown in FIG. 4 reduces the temperature of the natural gas entering the natural gas compressor 202 and so reduces the pressure and power required by the natural gas compressor 202. Additionally, the GAN vent 66 temperature is restored to be similar to the embodiment shown in FIG. 1.

Figure 5:
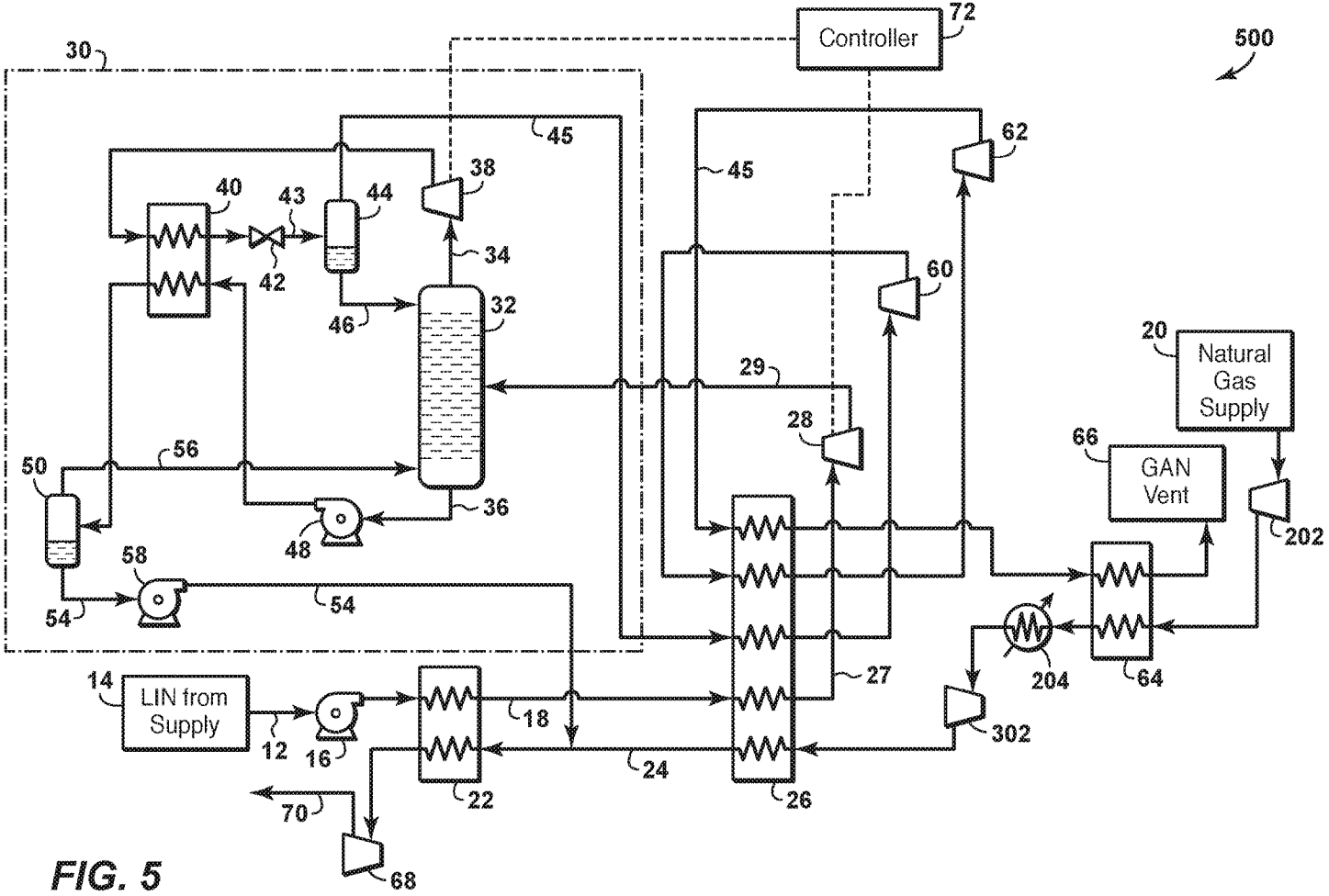
FIG. 5 is a schematic diagram of a system to liquefy natural gas to form LNG using liquid nitrogen as the sole refrigerant.

FIG. 5 depicts an LNG production system 500 similar to LNG production systems 300 and 400. In LNG production system 500, the third heat exchanger 64 is located between the natural gas compressor 202 and the natural gas cooler 204. This placement sacrifices the potential power reduction of the natural gas compressor 202 provided by LNG production system 400 (FIG. 4) but results in a large increase to the GAN vent temperature to significantly improve GAN plume buoyancy and dispersal. This placement also reduces the cooling duty of the natural gas cooler 204 and so reduces the size, capital cost and operating cost of the natural gas cooler 204 and its related support systems (e.g. cooling water, air-fin power supply, etc.).

Figure 6:
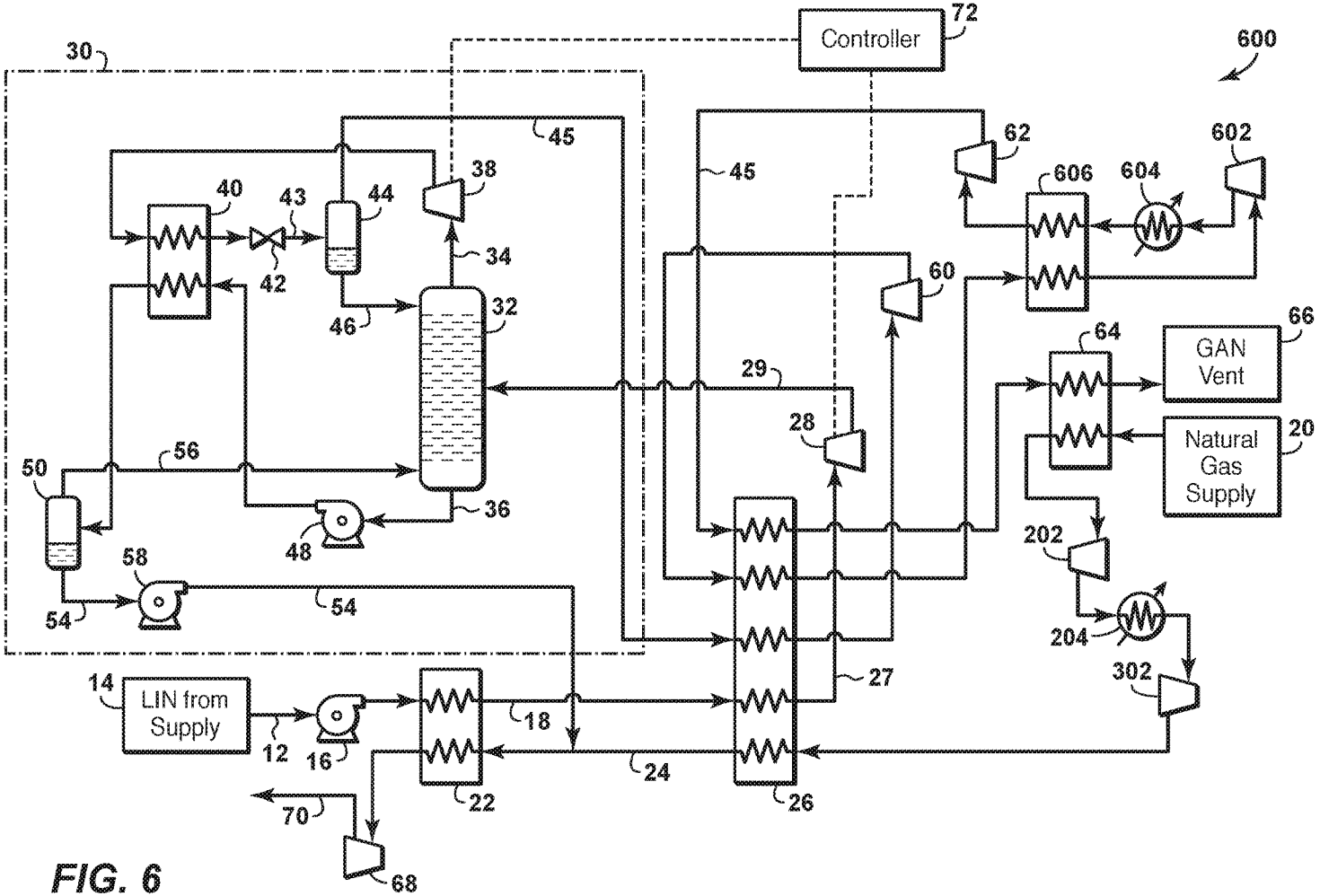
FIG. 6 is a schematic diagram of a system to liquefy natural gas to form LNG using liquid nitrogen as the sole refrigerant.

FIG. 6 illustrates an LNG production system 600 similar to LNG production system 400. In LNG production system 600, the GAN in the overhead product stream 45 is subjected to additional heat pump refrigeration in a heat pump system as the overhead product stream circulates through the second heat exchanger 26 and the second and third expanders 60, 62. As depicted in FIG. 6, the heat pump system includes a nitrogen compressor 602, a nitrogen cooler 604, and a feed-effluent heat exchanger 606 are added upstream of the third expander 62. The addition of this combination of the nitrogen compressor 602, the nitrogen cooler 604, and the feed-effluent heat exchanger 606 increases the pressure available at the inlet of the third expander 62 with only a small increase to the inlet temperature of the third expander 62. This combination of the nitrogen compressor 602, the nitrogen cooler 604, and feed-effluent heat exchanger 606 increases the power produced by the third expander 62 and increases the heat removed from the GAN in the overhead product stream 45 flowing through this portion of the LNG production system 600. This combination also results in a lower GAN temperature re-entering the second heat exchanger 26 compared to FIG. 4, and also results in an increase of the effectiveness of the available LIN supply in the LNG production system 600.

Figure 7:
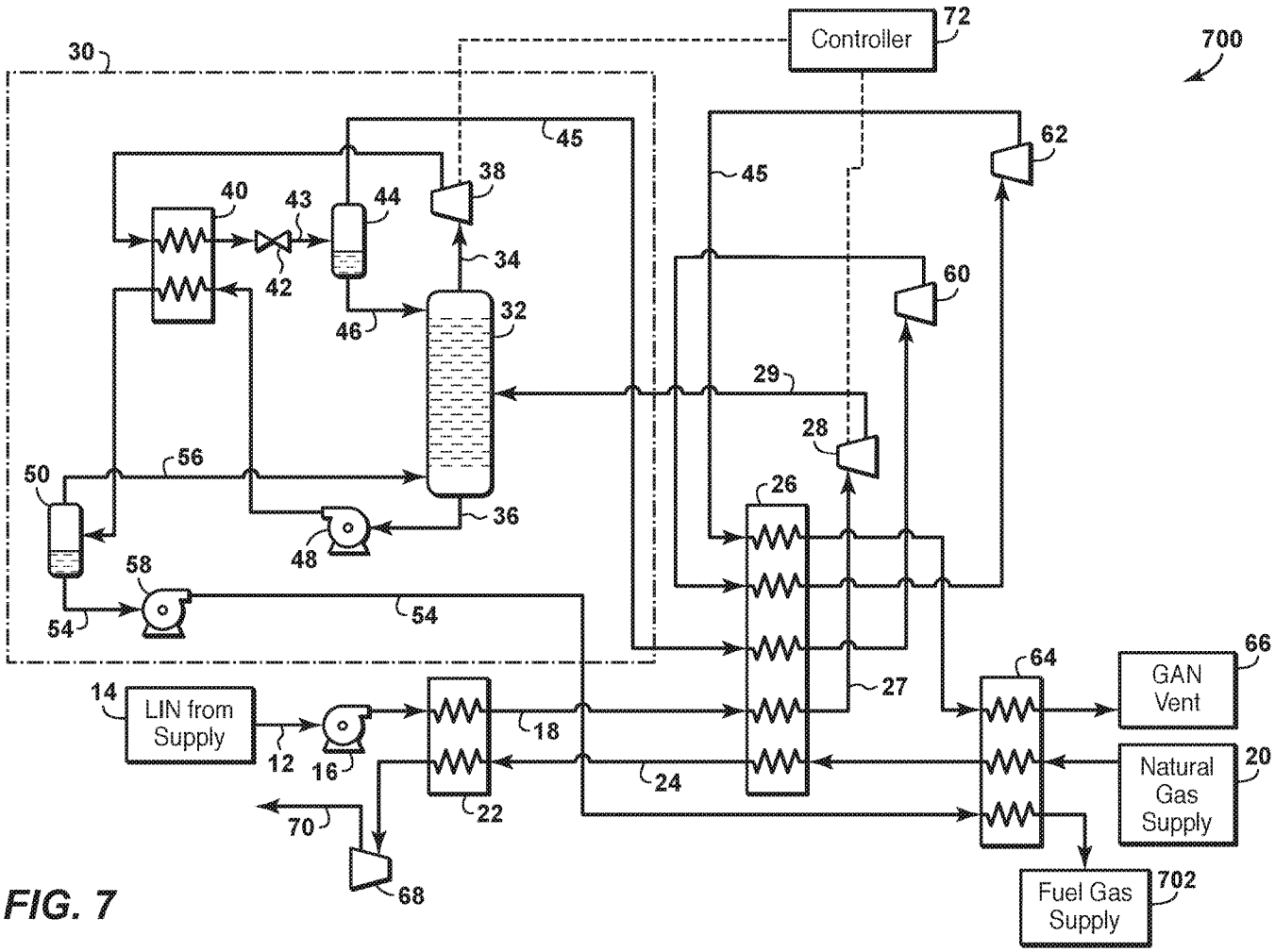
FIG. 7 is a schematic diagram of a system to liquefy natural gas to form LNG using liquid nitrogen as the sole refrigerant.

FIG. 7 depicts an LNG production system 700, similar to LNG production system 10, in which an alternative use of the separated greenhouse gas product stream 54 is shown. Instead of mixing the separated greenhouse gas product stream 54 with the natural gas stream 24, as shown in FIG. 1, the separated greenhouse gas product stream 54 may be used as a fuel gas supply 702 after being pumped to the required pressure in the greenhouse gas pump 58 and re-vaporized through one or more of the heat exchangers. As an example, FIG. 7 shows the separated greenhouse gas product stream 54 passing through the third heat exchanger 64. Other uses of the separated greenhouse gas product stream are possible and generally known to those skilled in the art.

Figure 8:
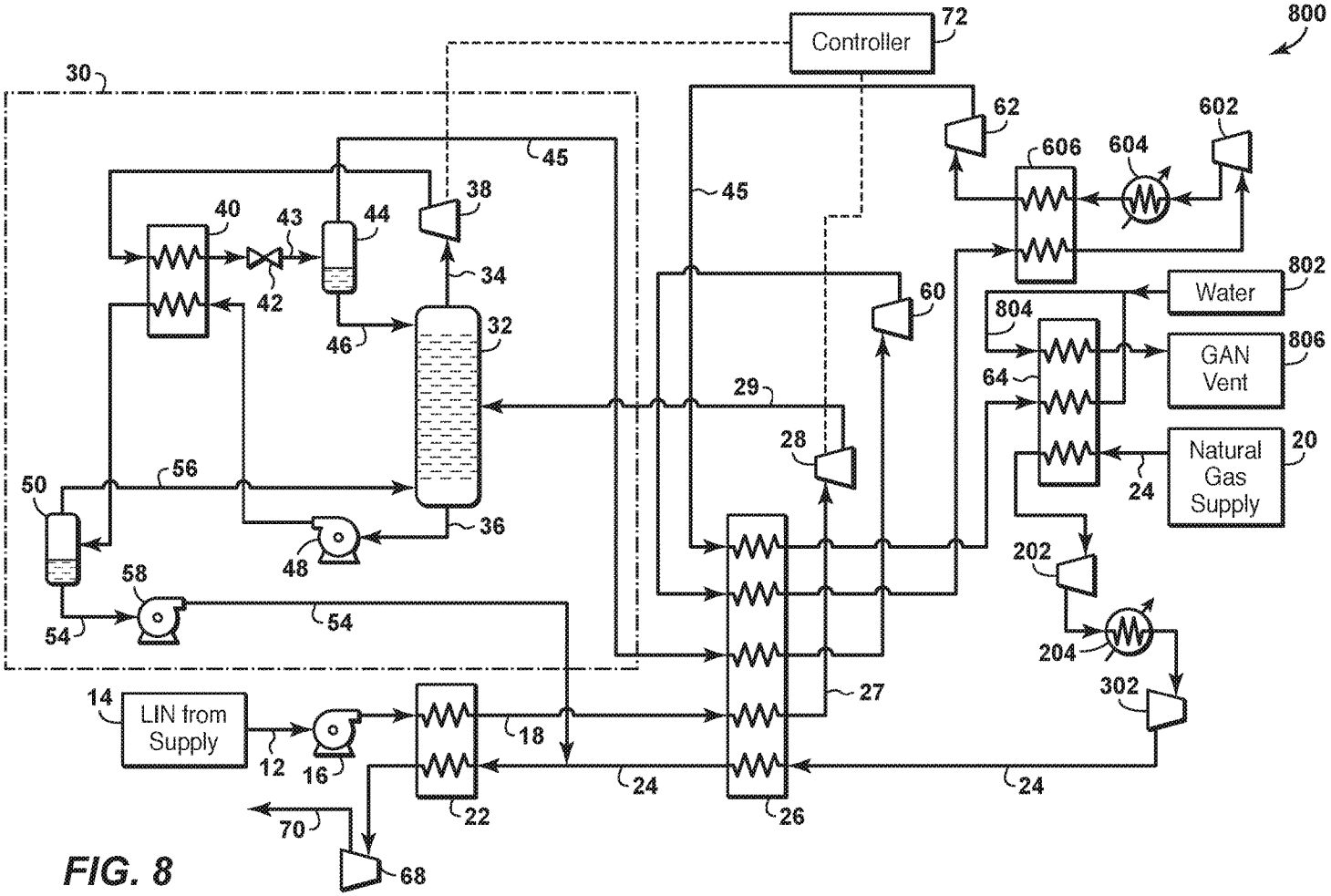
FIG. 8 is a schematic diagram of a system to liquefy natural gas to form LNG using liquid nitrogen as the sole refrigerant.

FIG. 8 depicts an LNG production system 800 similar to LNG production systems 10, 200, 400, and 600. In LNG production system 800, the very dry composition of the GAN in the overhead product stream 45 is used to effect further cooling within the LNG production system 800. Psychometric cooling of the GAN in the overhead product stream 45 can reduce the temperature of that stream to within a few degrees Celsius of the freezing temperature of water, or about 2-5 degrees Celsius by the addition and saturation of water 802 to the overhead product stream 45 after the overhead product stream 45 has passed through the third heat exchanger 64 as shown in FIG. 8. The now wet or saturated GAN stream 804, with its lower temperature, may be re-routed through the third heat exchanger 64 (or other appropriate heat exchanger) to further pre-chill the incoming natural gas stream. Those skilled in the art will recognize that many techniques are available to effect this psychometric cooling, including spraying of water via fogging or other nozzles into the flowing GAN stream, or passing the GAN and water over trays, packing material, or other heat and mass transfer device(s) within a tower, column or cooling tower-like device. Alternatively, cooling water or another heat transfer fluid may be further chilled via such psychometric cooling by passing the very dry GAN through a cooling tower-like device. This further chilled cooling water may then be used to pre-chill other streams within the LNG production system 800 to enhance the effectiveness of the available LIN supply. Finally, adding water vapor to the otherwise very dry gaseous nitrogen reduces the specific gravity of the GAN and improves GAN plume buoyancy and dispersal if the GAN is vented at 806.

The included figures each depict a greenhouse gas removal unit 30 as part of an LNG production system 10, 200, 300, 400, 500, 600, 700, 800, where the greenhouse gas removal unit is depicted as based on distillation technologies and methodologies. Alternative systems and methods may be used to remove the greenhouse gas contaminants of the LIN supply 14. These alternative methods are not shown in detail but may include: adsorption processes including pressure-swing, temperature-swing or a combination of pressure and temperature-swing adsorption; bulk adsorption or absorption such as by an activated carbon bed; or catalytic processes.

Figure 9:
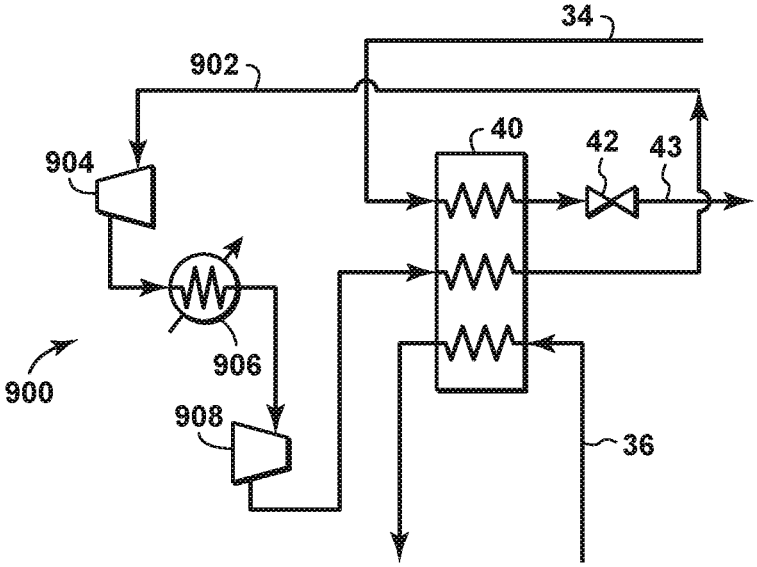
FIG. 9 is a schematic diagram of a supplemental refrigeration system.

The heat exchangers in the disclosed embodiments have been described as being cooled by solely by LIN, GAN, or a combination thereof, sourced from the LIN supply 14. However, it is possible to increase the cooling capability of any of the disclosed heat exchangers by employing a supplemental refrigeration system having no fluid connection with the natural gas or nitrogen in the LNG production system 10. The refrigerant used by the supplemental refrigeration system may comprise any suitable hydrocarbon gas (e.g., alkenes or alkanes such as methane, ethane, ethylene, propane, etc.), inert gases (e.g., nitrogen, helium, argon, etc.), or other refrigerants known to those skilled in the art. FIG. 9 depicts a supplemental refrigeration system 900 providing additional cooling capability to the heat pump heat exchanger 40 of the greenhouse gas removal unit 30 using an argon stream 902 as the refrigerant. The supplemental refrigeration system 900 includes a supplemental compressor 904 that compresses the argon stream 902 to a suitable pressure. The argon stream 902 then passes through a supplemental heat exchanger, shown in FIG. 9 as a cooler 906. The argon stream 902 then passes through a supplemental pressure reduction device 908 such as a Joule-Thompson valve or an expander. The argon stream 902 then passes through the heat pump heat exchanger 40 to supplement the cooling efforts of the GAN in the distillation column overhead stream 34 to cool the greenhouse gases in the greenhouse gas product stream 36. The argon stream 902 then recirculates through the supplemental compressor 904 as previously described.

A supplemental refrigeration system similar to supplemental refrigeration system 900 may be used to increase the cooling effectiveness of other heat exchangers disclosed herein, such as the first heat exchanger 22, second heat exchanger 26, third heat exchanger 64, and/or the feed-effluent heat exchanger 606. Further, while the refrigerant of the supplemental refrigeration system 900 is not fluidly connected to the LNG production system 10, in some embodiments the refrigerant may be sourced from natural gas streams and/or nitrogen streams of the LNG production system. Further, the supplemental heat exchanger 906 may exchange heat (or cold) with gaseous streams and/or liquid streams of the LNG production system 10, such as the LIN stream 12, natural gas stream 24, cGAN stream 27, or the greenhouse gas product stream 36.

Figure 10:
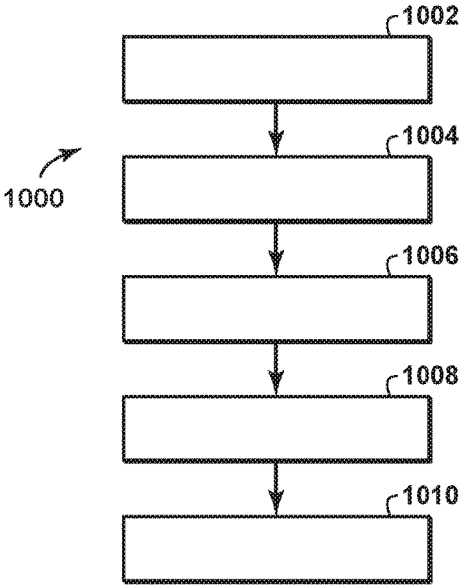
FIG. 10 is a flowchart of a method of liquefying natural gas to form LNG.

FIG. 10 illustrates a method 1000 of producing LNG using LIN as a primary refrigerant according to disclosed aspects. At block 1002 a natural gas stream is provided from a supply of natural gas. At block 1004 a liquefied nitrogen stream is provided from a supply of liquefied nitrogen. At block 1006 the natural gas stream and the liquefied nitrogen stream are passed through a first heat exchanger that exchanges heat between the liquefied nitrogen stream and the natural gas stream to at least partially vaporize the liquefied nitrogen stream and at least partially condense the natural gas stream. The liquefied nitrogen stream is circulated through the first heat exchanger at least one time, but preferably at least three times. At block 1008 the pressure of the at least partially vaporized nitrogen stream may be reduced, preferably using at least one expander service. At block 1010 greenhouse gas is removed from the at least partially vaporized nitrogen stream using a greenhouse gas removal unit, such as greenhouse gas removal unit 30.

Figure 11:
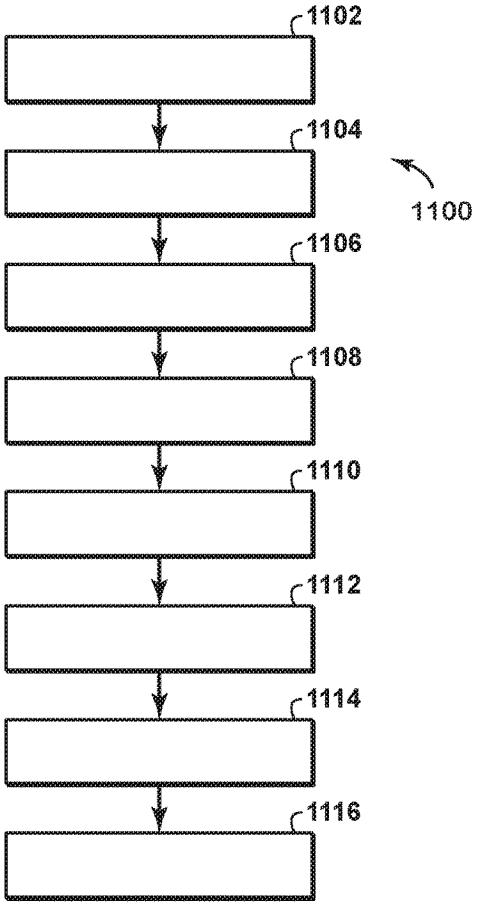
FIG. 11 is a flowchart of a method of removing greenhouse gas contaminants in a liquid nitrogen stream used to liquefy a natural gas stream.

FIG. 11 illustrates a method 1100 of removing greenhouse gas contaminants in a liquid nitrogen stream used to liquefy a natural gas stream. At block 1102 the natural gas stream and the liquefied nitrogen stream are passed through a first heat exchanger that exchanges heat between the liquefied nitrogen stream and the natural gas stream to at least partially vaporize the liquefied nitrogen stream and at least partially condense the natural gas stream. The liquefied nitrogen stream is circulated through the first heat exchanger at least one time, and preferably at least three times. At block 1104 the pressure of the at least partially vaporized nitrogen stream may be reduced, preferably using at least one expander service. At block 1106 a greenhouse gas removal unit is provided that includes a distillation column and heat pump condenser and reboiler system. At block 1108 the pressure and condensing temperature of an overhead stream of the distillation column is increased. At block 1110 the overhead stream of the distillation column and a bottoms stream of the distillation column are cross-exchanged to affect both the overhead condenser duty and the bottom reboiler duty of the distillation column. At block 1112 the pressure of the distillation column overhead stream is reduced after the cross-exchanging step to produce a reduced-pressure distillation column overhead stream. At block 1114 the reduced-pressure distillation column overhead stream is separated to produce a first separator overhead stream of gaseous nitrogen that exits the greenhouse gas removal unit having greenhouse gases removed therefrom. At block 1116 the first separator overhead stream is vented to atmosphere.

The embodiments and aspects provide an effective method of removing greenhouse gas contaminants from an LIN stream used to liquefy natural gas. An advantage of the invention is that the heat pump system in the greenhouse gas removal unit 30 removes the necessity of external heating or cooling sources to separate the greenhouse gases from the nitrogen.

Another advantage of the efficient removal of greenhouse gases from LIN is that LIN storage facilities can more economically be used as LNG storage facilities, thereby reducing the areal footprint of natural gas processing facilities.

Still another advantage is that the gaseous nitrogen may be vented without the unwanted release of greenhouse gases into the atmosphere.

Although exemplary embodiments discussed herein in with respect to FIGS. 1-11 are directed to producing LNG using LIN as primary coolant, a person of ordinary skill in the art would understand that the principles apply to other cooling methods and coolants. For example, the disclosed methods and systems may be used where there is no common storage for LNG and LIN, and it is desired simply to purify a coolant used in LNG or other liquefaction methods.

Embodiments of the invention may include any combinations of the methods and systems shown in the following numbered paragraphs. This is not to be considered a complete listing of all possible embodiments, as any number of variations can be envisioned from the description above.

1. A liquefied natural gas production system using liquid nitrogen as a primary refrigerant, the system comprising:
   - a natural gas stream from a supply of natural gas;
   - a liquefied nitrogen stream from a supply of liquefied nitrogen;
   - at least one heat exchanger that exchanges heat between the liquefied nitrogen stream and the natural gas stream to at least partially vaporize the liquefied nitrogen stream and at least partially condense the natural gas stream; and
   - a greenhouse gas removal unit configured to remove greenhouse gas from the at least partially vaporized nitrogen stream.

2. The liquefied natural gas production system of paragraph 1, wherein the liquefied nitrogen stream is circulated through a first of the at least one heat exchanger at least three times.

3. The liquefied natural gas production system of paragraphs 1 or 2, further comprising at least one expander service that reduces a pressure of the at least partially vaporized nitrogen stream.

4. The liquefied natural gas production system of any of paragraphs 1-3, wherein the greenhouse gas removal unit comprises at least one of a distillation column, an absorption system, an adsorption system, and a catalytic system.

5. The liquefied natural gas production system of any of paragraphs 1-4, wherein the greenhouse gas removal unit comprises a distillation column having a heat pump condenser and reboiler system.

6. The liquefied natural gas production system of paragraph 5, further comprising at least one expander service that reduces the pressure of the at least partially vaporized nitrogen stream, wherein an inlet stream of the distillation column is an outlet stream of a first of the at least one expander service.

7. The liquefied natural gas production system of paragraphs 5 or 6, wherein the heat pump condenser and reboiler system further comprises a compressor that increases a pressure and condensing temperature of an overhead stream of the distillation column, a heat pump heat exchanger to cross-exchange the overhead stream of the distillation column and a bottoms stream of the distillation column to affect both an overhead condenser duty and a bottom reboiler duty of the distillation column, a pressure reduction device, connected to an output of the heat pump heat exchanger, and configured to reduce a pressure of the distillation column overhead stream after the distillation column overhead stream has passed through the heat pump heat exchanger, and a separator, connected to an output of the pressure reduction device, and configured to produce a first separator overhead stream, wherein the first separator overhead stream is gaseous nitrogen that exits the greenhouse gas removal unit having greenhouse gases removed therefrom.

8. The liquefied natural gas production system of paragraph 7, further comprising:

at least one expander service that reduces the pressure of the at least partially vaporized nitrogen stream; and a controller that adjusts an inlet temperature of a first of the at least one expander service to affect an overhead condenser duty and a bottom reboiler duty of the distillation column.

9. The liquefied natural gas production system of paragraph 8, wherein an increase of the inlet temperature of the first of the at least one expander service increases the overhead condenser duty and decreases the reboiler duty, and further wherein and a decrease of the inlet temperature of the first of the at least one expander service decreases the overhead condenser duty and increases the boiler duty.

10. The liquefied natural gas production system of paragraph 8, wherein the controller is further configured to control the compressor to adjust the increase in the pressure of the overhead stream of the distillation column, thereby changing overall heat transfer in the heat pump heat exchanger.

11. The liquefied natural gas production system of any of paragraphs 7-10, further comprising a nitrogen vent system that vents the first separator overhead stream to atmosphere.

12. The liquefied natural gas production system of any of paragraphs 7-11, further comprising a second heat exchanger in which the first separator overhead stream exchanges heat with the natural gas stream to increase a temperature of the first separator overhead stream to at least ambient temperature prior to the first separator overhead stream entering the nitrogen vent system.

13. The liquefied natural gas production system of system of any of paragraphs 1-12, further comprising a pressure reducer that reduces a pressure of the at least partially condensed natural gas stream.

14. The liquefied natural gas production system of paragraph 13, wherein the pressure reducer is one or more of a hydraulic turbine and a Joule-Thomson valve.

15. The liquefied natural gas production system of any of paragraphs 1-14, further comprising a pump that pumps the liquefied nitrogen stream to a pressure of at least 20 bara.

16. The liquefied natural gas production system of any of paragraphs 1-15, wherein the greenhouse gases removed from the at least partially vaporized nitrogen stream comprise a greenhouse gas product stream, and further comprising a greenhouse gas pump that increases a pressure of the greenhouse gas product stream.

17. The liquefied natural gas production system of paragraph 16, wherein the greenhouse gas product stream is combined with the at least partially condensed natural gas stream.

18. The liquefied natural gas production system of paragraphs 16 or 17, wherein the greenhouse gas product stream is re-vaporized to form a pressurized gaseous product.

19. The liquefied natural gas production system of any of paragraphs 1-18, further comprising a heat pump system through which the at least partially vaporized nitrogen stream flows after flowing through a first of the at least one expander service.

20. The liquefied natural gas production system of any of paragraphs 1-19, wherein the heat pump system includes a nitrogen compressor, a nitrogen cooler, and a feed-effluent heat exchanger.

21. The liquefied natural gas production system of any of paragraphs 1-20, wherein the greenhouse gas comprises at least one of methane, ethane, propane, butane, ethene, propene, and butene.

22. The liquefied natural gas production system of any of paragraphs 1-21, further comprising a psychometric heat exchanger that uses the at least partially vaporized nitrogen stream to pre-chill the natural gas stream prior to the natural gas stream entering the at least one heat exchanger.

23. The liquefied natural gas production system of paragraph 22, wherein a specific gravity of the at least partially vaporized nitrogen stream is reduced by at least 0.2% by the psychometric heat exchanger.

24. A method of producing liquefied natural gas (LNG) using liquid nitrogen as a primary refrigerant, the method comprising:

providing a natural gas stream from a supply of natural gas;

providing a liquefied nitrogen stream from a supply of liquefied nitrogen;

passing the natural gas stream and the liquefied nitrogen stream through a first heat exchanger that exchanges heat between the liquefied nitrogen stream and the natural gas stream to at least partially vaporize the liquefied nitrogen stream and at least partially condense the natural gas stream; and removing greenhouse gas from the at least partially vaporized nitrogen stream using a greenhouse gas removal unit.

25. The method of paragraph 24, wherein the greenhouse gas removal unit comprises a distillation column and a heat pump condenser and reboiler system, and further comprising:

increasing a pressure and condensing temperature of an overhead stream of the distillation column;

cross-exchanging the overhead stream of the distillation column and a bottoms stream of the distillation column to affect both an overhead condenser duty and a bottom reboiler duty of the distillation column;

reducing a pressure of the distillation column overhead stream after the cross-exchanging step to produce a reduced-pressure distillation column overhead stream; and separating the reduced-pressure distillation column overhead stream to produce a first separator overhead stream, wherein the first separator overhead stream is gaseous nitrogen that exits the greenhouse gas removal unit having greenhouse gases removed therefrom.

26. The method of paragraph 25, further comprising venting the first separator overhead stream to atmosphere.

27. The method of paragraphs 25 or 26, further comprising providing a second heat exchanger in which the first separator overhead stream exchanges heat with the natural gas stream to increase a temperature of the first separator overhead stream to at least ambient temperature prior to the first separator overhead stream being vented to atmosphere.

28. The method of paragraph 27, further comprising:

reducing a pressure of the at least partially vaporized nitrogen stream using at least one expander service; and controlling an inlet temperature of the at least one expander service to affect the overhead condenser duty and a bottom reboiler duty of the distillation column.

29. The method of paragraph 28, further comprising controlling the increase in the pressure and condensing temperature of the overhead stream of the distillation column, thereby changing overall heat transfer during the cross-exchanging step.

30. The method of any of paragraphs 24-29, further comprising combining the greenhouse gas removed from the at least partially vaporized nitrogen stream with the natural gas stream.

31. The method of any of paragraphs 24-30, further comprising flowing the at least partially vaporized nitrogen stream through a heat pump system after flowing through a first of the at least one expander service.

32. The method of any of paragraphs 24-31, wherein the liquefied nitrogen stream is circulated through the first heat exchanger at least three times.

33. A method of removing greenhouse gas contaminants in a liquid nitrogen stream used to liquefy a natural gas stream, comprising:

passing the natural gas stream and the liquefied nitrogen stream through a first heat exchanger that exchanges heat between the liquefied nitrogen stream and the natural gas stream to at least partially vaporize the liquefied nitrogen stream and at least partially condense the natural gas stream, wherein the liquefied nitrogen stream is circulated through the first heat exchanger at least three times;

reducing a pressure of the at least partially vaporized nitrogen stream using at least one expander service;

providing a greenhouse gas removal unit that includes a distillation column and heat pump condenser and reboiler system;

increasing a pressure and condensing temperature of an overhead stream of the distillation column;

cross-exchanging the overhead stream of the distillation column and a bottoms stream of the distillation column to affect both an overhead condenser duty and a bottom reboiler duty of the distillation column;

reducing a pressure of the distillation column overhead stream after the cross-exchanging step to produce a reduced-pressure distillation column overhead stream;

separating the reduced-pressure distillation column overhead stream to produce a first separator overhead stream, wherein the first separator overhead stream is gaseous nitrogen that exits the greenhouse gas removal unit having greenhouse gases removed therefrom; and venting the first separator overhead stream to atmosphere.

While the foregoing is directed to embodiments of the present invention, other and further embodiments of the invention may be devised without departing from the basic scope thereof, and the scope thereof is determined by the claims that follow.

What is claimed is:

1. A liquefied natural gas production system using liquid nitrogen as a primary refrigerant, the system comprising:

a natural gas stream from a supply of natural gas;

a liquefied nitrogen stream from a supply of liquefied nitrogen;

at least one heat exchanger that exchanges heat between the liquefied nitrogen stream and the natural gas stream to at least partially vaporize the liquefied nitrogen stream and at least partially condense the natural gas stream; and a greenhouse gas removal unit comprising a distillation column having a heat pump condenser and reboiler system, the greenhouse gas removal unit configured to remove greenhouse gas from the at least partially vaporized nitrogen stream, wherein the heat pump condenser and reboiler system further comprises a compressor that increases a pressure and condensing temperature of an overhead stream of the distillation column, a heat pump heat exchanger to cross-exchange the overhead stream of the distillation column and a bottom stream of the distillation column to affect both an overhead condenser duty and a bottom reboiler duty of the distillation column, a pressure reduction device, connected to an output of the heat pump heat exchanger, and configured to reduce a pressure of the distillation column overhead stream after the distillation column overhead stream has passed through the heat pump heat exchanger, and a separator, connected to an output of the pressure reduction device, and configured to produce a first separator overhead stream, wherein the first separator overhead stream is gaseous nitrogen that exits the greenhouse gas removal unit having greenhouse gases removed therefrom;

at least one expander service that reduces the pressure of the at least partially vaporized nitrogen stream; and a controller that adjusts an inlet temperature of a first of the at least one expander service to affect an overhead condenser duty and a bottom reboiler duty of the distillation column.

2. The liquefied natural gas production system of claim 1, wherein the liquefied nitrogen stream is circulated through one of the at least one heat exchanger at least three times.

3. The liquefied natural gas production system of claim 1, further comprising at least one expander service that reduces the pressure of the at least partially vaporized nitrogen stream, wherein an inlet stream of the distillation column is an outlet stream of a first of the at least one expander service.

4. The liquefied natural gas production system of claim 1, wherein an increase of the inlet temperature of the first of the at least one expander service increases the overhead condenser duty and decreases the reboiler duty, and further wherein and a decrease of the inlet temperature of the first of the at least one expander service decreases the overhead condenser duty and increases the boiler duty.

5. The liquefied natural gas production system of claim 1, wherein the controller is further configured to control the compressor to adjust the increase in the pressure of the overhead stream of the distillation column, thereby changing overall heat transfer in the heat pump heat exchanger.

6. The liquefied natural gas production system of claim 1, further comprising a nitrogen vent system that vents the first separator overhead stream to atmosphere.

7. The liquefied natural gas production system of claim 6, further comprising a second heat exchanger in which the first separator overhead stream exchanges heat with the natural gas stream to increase a temperature of the first separator overhead stream to at least ambient temperature prior to the first separator overhead stream entering the nitrogen vent system.

8. The liquefied natural gas production system of system of claim 1, wherein the pressure reduction device is a first pressure reduction device, and further comprising a second pressure reduction device that reduces a pressure of the at least partially condensed natural gas stream.

9. The liquefied natural gas production system of claim 8, wherein the second pressure reduction device is one or more of a hydraulic turbine and a Joule-Thomson valve.

10. The liquefied natural gas production system of claim 1, further comprising a pump that pumps the liquefied nitrogen stream to a pressure of at least 20 bara.

11. The liquefied natural gas production system of claim 1, wherein the greenhouse gases removed from the at least partially vaporized nitrogen stream comprise a greenhouse gas product stream, and further comprising a greenhouse gas pump that increases a pressure of the greenhouse gas product stream.

12. The liquefied natural gas production system of claim 11, wherein the greenhouse gas product stream is combined with the at least partially condensed natural gas stream.

13. The liquefied natural gas production system of claim 1, further comprising a heat pump system through which the at least partially vaporized nitrogen stream flows after flowing through a first of the at least one expander service.

14. The liquefied natural gas production system of claim 13, wherein the heat pump system includes a nitrogen compressor, a nitrogen cooler, and a feed-effluent heat exchanger.

15. The liquefied natural gas production system of claim 1, wherein the greenhouse gas comprises at least one of methane, ethane, propane, butane, ethene, propene, and butene.

16. The liquefied natural gas production system of claim 1, further comprising a psychometric heat exchanger that uses the at least partially vaporized nitrogen stream to pre-chill the natural gas stream prior to the natural gas stream entering the at least one heat exchanger.

17. The liquefied natural gas production system of claim 16, wherein a specific gravity of the at least partially vaporized nitrogen stream is reduced by at least 0.2% by the psychometric heat exchanger.

18. A method of producing liquefied natural gas (LNG) using liquid nitrogen as a primary refrigerant, the method comprising:

providing a natural gas stream from a supply of natural gas;

providing a liquefied nitrogen stream from a supply of liquefied nitrogen;

passing the natural gas stream and the liquefied nitrogen stream through a first heat exchanger that exchanges heat between the liquefied nitrogen stream and the natural gas stream to at least partially vaporize the liquefied nitrogen stream and at least partially condense the natural gas stream; and removing greenhouse gas from the at least partially vaporized nitrogen stream using a greenhouse gas removal unit, wherein the greenhouse gas removal unit comprises a distillation column and a heat pump condenser and reboiler system;

increasing a pressure and condensing temperature of an overhead stream of the distillation column;

cross-exchanging the overhead stream of the distillation column and a bottoms stream of the distillation column to affect both an overhead condenser duty and a bottom reboiler duty of the distillation column;

reducing a pressure of the distillation column overhead stream after the cross-exchanging step to produce a reduced-pressure distillation column overhead stream; and separating the reduced-pressure distillation column overhead stream to produce a first separator overhead stream, wherein the first separator overhead stream is gaseous nitrogen that exits the greenhouse gas removal unit having greenhouse gases removed therefrom;

providing a second heat exchanger in which the first separator overhead stream exchanges heat with the natural gas stream to increase a temperature of the first separator overhead stream to at least ambient temperature prior to the first separator overhead stream being vented to atmosphere;

reducing a pressure of the at least partially vaporized nitrogen stream using at least one expander service; and controlling an inlet temperature of the at least one expander service to affect the overhead condenser duty and the bottom reboiler duty of the distillation column.

19. The method of claim 18, further comprising venting the first separator overhead stream to atmosphere.

20. The method of claim 18, further comprising controlling the increase in the pressure and condensing temperature of the overhead stream of the distillation column, thereby changing overall heat transfer during the cross-exchanging step.

21. The method of claim 18, further comprising combining the greenhouse gas removed from the at least partially vaporized nitrogen stream with the natural gas stream.

22. The method of claim 18, further comprising flowing the at least partially vaporized nitrogen stream through a heat pump system after flowing through a first of the at least one expander service.

23. The method of claim 18, wherein the liquefied nitrogen stream is circulated through the first heat exchanger at least three times.

* * * * *